US005352147A

United States Patent [19]

Nagel et al.

[11] Patent Number: 5,352,147

[45] Date of Patent: Oct. 4, 1994

[54] TOY VEHICLE AND METHOD OF MANUFACTURE

[76] Inventors: Dietmar Nagel, 147 South Rd., Chester, N.J. 07930; Craig P. Nadel, 201 Wingate Rd., Parsippany, N.J. 07054

[21] Appl. No.: 998,999

[22] Filed: Dec. 31, 1992

[51] Int. Cl.[5] ..... A63H 17/28; A63H 17/34

[52] U.S. Cl. ..... 446/409; 446/439; 446/485

[58] Field of Search ..... 446/409, 438, 439, 470, 446/485, 484

[56] References Cited

U.S. PATENT DOCUMENTS

| | | | |
|---|---|---|---|
| 2,697,300 | 12/1954 | Lohr et al. | 446/439 |
| 2,765,584 | 10/1956 | Zion | 446/470 |
| 4,889,514 | 12/1989 | Auer et al. | 446/439 X |
| 4,991,066 | 2/1991 | McCowan | 446/438 X |
| 5,154,658 | 10/1992 | Marcus | 446/409 X |

FOREIGN PATENT DOCUMENTS 984782 3/1965 United Kingdom ..... 446/439

*Primary Examiner*—Mickey Yu

*Attorney, Agent, or Firm*—Cohen, Pontani, Lieberman, Pavane

[57] ABSTRACT

A toy vehicle includes a vehicle body having at least one substantially transparent portion and an opaque portion. The substantially transparent portion includes a substantially stripe-shaped pattern extending from the front of the vehicle body to the rear sides thereof. The opaque portion is defined as the entire body except for the substantially transparent portion. A plurality of illuminating devices are disposed within the body and proximate the stripe-shaped pattern of the substantially transparent portion so that when each of the illuminating devices emits light, the emitted light is transmitted through the substantially transparent portion for viewing from the exterior side of the body. An operable control circuit causes the lights to be sequentially illuminated along the stripe-shaped pattern, thereby simulating vehicle motion.

10 Claims, 4 Drawing Sheets

FIG.4
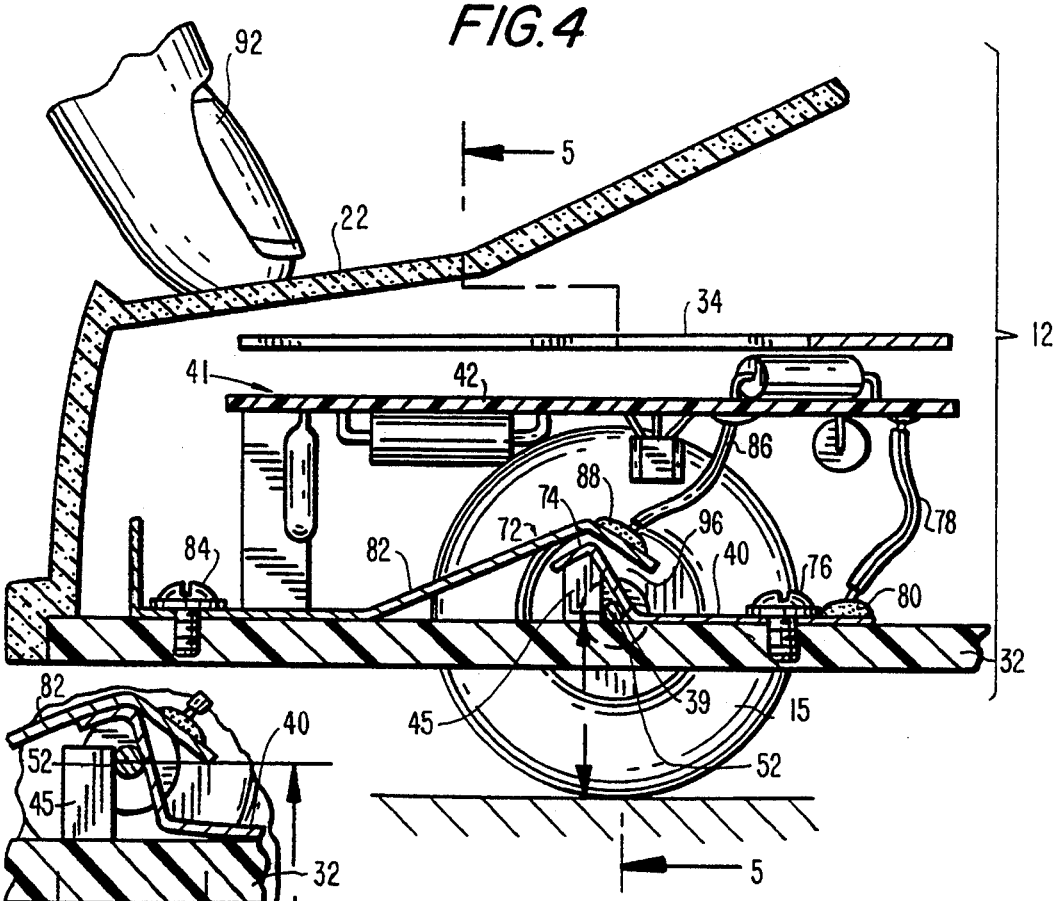
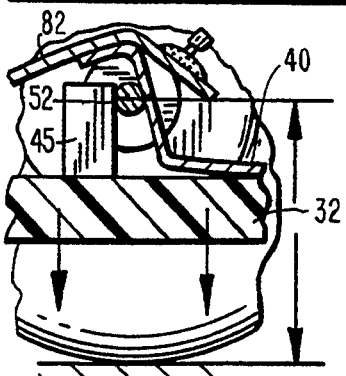
FIG.4A
FIG.5
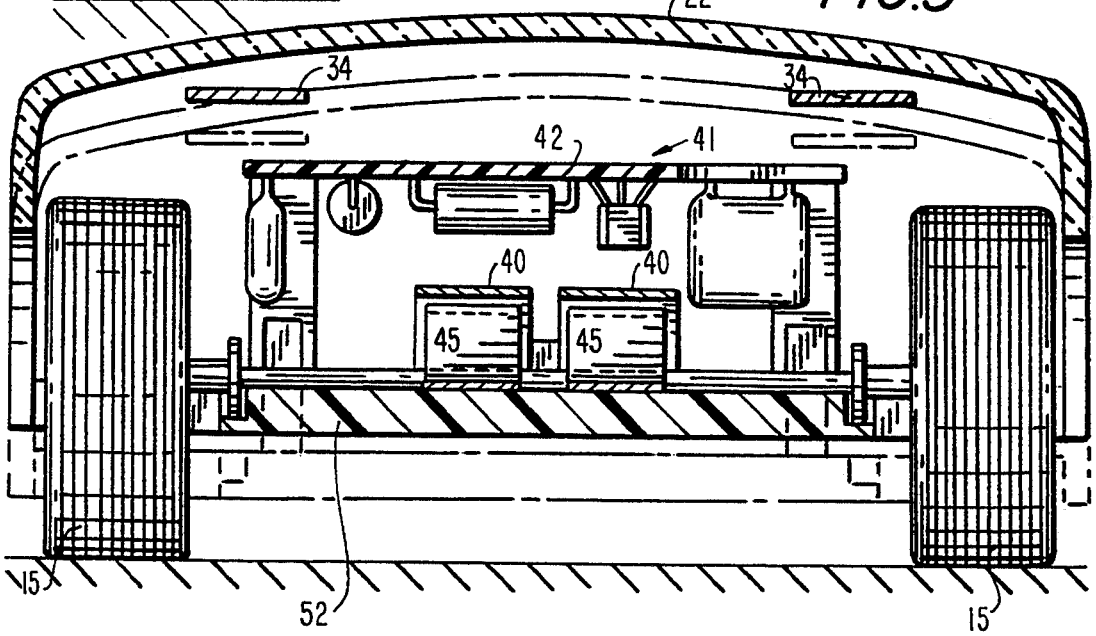

TOY VEHICLE AND METHOD OF MANUFACTURE

FIELD OF THE INVENTION

The present invention generally relates to toy vehicles and, more particularly, to a toy automobile that is operable to simulate motion by sequentially flashing a series of lights and by generating movement-simulating sounds in concert with the flashing lights. The present invention also relates to a method for manufacturing such a toy vehicle.

BACKGROUND OF THE INVENTION

Children, and even adults, enjoy playing with and collecting toy vehicles. Children in particular enjoy playing with toy vehicles that can stimulate the children's senses to n allow them to creatively use their imagination. In general, these toy vehicles have a somewhat utilitarian shape which is visually pleasing and/or stimulating to the children. Additionally, such toy vehicles usually comprise a body portion having a combination of areas of various colors, designs, and relative transparencies and opacities.

Some toy vehicles may include, for example, motors for causing the vehicles to move, sound generators for simulating, for example, engines sounds, horns or the like, and lights for adding realism or for providing a pleasing visual effect.

Other toy vehicles, such as automobile models, are merely exact replicas of the actual automobile they model. These models typically include as much detail as practical in the body design to make the models appear authentic. Yet these models lack features which simulate motion, sight or sound. While these toy automobiles have a pleasing visual effect, they generally are not much as fun to play with and are not therefore less interesting to many children.

As discussed above, some toy vehicles include various types of lights. These lights are usually located within the interior of the toy vehicle, and as such the toys must be provided with at least one transparent or translucent portion for permitting the light to be emitted therefrom. In general, these toys have bodies molded or otherwise formed of an opaque material, such as a suitable plastic. To form the transparent or translucent portions, appropriately placed holes or openings or cutouts are defined in the intended vicinity of the lights or windows, as for example by cutting or by providing appropriate openings in the body as molded or formed. Transparent or translucent material is the typically inserted into these cutouts and is secured frictionally or by an adhesive. This method of manufacture is unduly complex, time consuming, expensive and inefficient.

OBJECTS OF THE INVENTION

Accordingly, it is an object of the present invention to provide a toy vehicle that is of less complex construction and less expensive to manufacture than has heretofore been known.

It is a further object of the invention to provide a toy vehicle operable to produce visual and sound effects simulating motion.

It is a still further object of the invention to provide a toy vehicle having a plurality of sequentially flashing lights and a sound generator for generating a motion-simulating sound in concert with the lights.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

SUMMARY OF THE INVENTION

According to one aspect of the present invention, a method is provided for manufacturing a toy vehicle and includes the step of forming a substantially transparent vehicle body or shell having an interior side and an exterior side. At least one substantially transparent portion of the body is defined having a substantially stripe-shaped pattern. The substantially stripe-shaped pattern extends from substantially the front of the vehicle body and along one side of the body. An opaque portion of the body is defined comprising all of the body except for the at least one substantially transparent portion. A mask is arranged protectively on or proximate to the vehicle body, such that the mask is disposed over the at least one substantially transparent portion. A coating material is applied to the vehicle body and to the mask so that the coating material is applied to the vehicle body only at the predefined opaque portion. In this arrangement, the coating material blocks transmission of light from the interior side to the exterior side of the body at and throughout the opaque portion. A plurality of illuminating devices are mounted within the body and proximate the at least one substantially transparent portion such that when each of the illuminating devices is operated to emit light, the emitted light is transmitted through the at least one substantially transparent portion for viewing from the exterior side of the body. A controller repeatedly and sequentially energizes and deenergizes the plural illuminating devices for illumination. In the preferred embodiment, the illuminating devices are sequentially and serially illuminated from the front of the substantially stripe-shaped pattern to the rear thereof.

According to another aspect of the present invention, a toy vehicle includes a vehicle body or shell having at least one substantially transparent portion and an opaque portion. The substantially transparent portion includes a substantially stripe-shaped pattern extending from the front of the vehicle body to the side rear thereof. The opaque portion comprises all of the body except for the substantially transparent portion. A plurality of illuminating devices are disposed within the body and proximate the stripe-shaped pattern of the substantially transparent portion such that when each of the plural illuminating devices emit light, the emitted light is transmitted through the substantially transparent portion for viewing from the exterior side of the body.

DETAILED DESCRIPTION OF THE DRAWINGS

In the drawings, wherein like reference characters denote similar elements throughout the several views:

FIG. 4 is a cross-sectional view taken along the lines 4—4 of FIG. 1;

FIG. 4A is a partial cross-sectional view showing the actuating switch in its closed position;

FIG. 5 is a cross-sectional view taken along the lines 5—5 of FIG. 4; and

DETAILED DESCRIPTION OF THE PRESENTLY PREFERRED EMBODIMENTS

Figure 1:
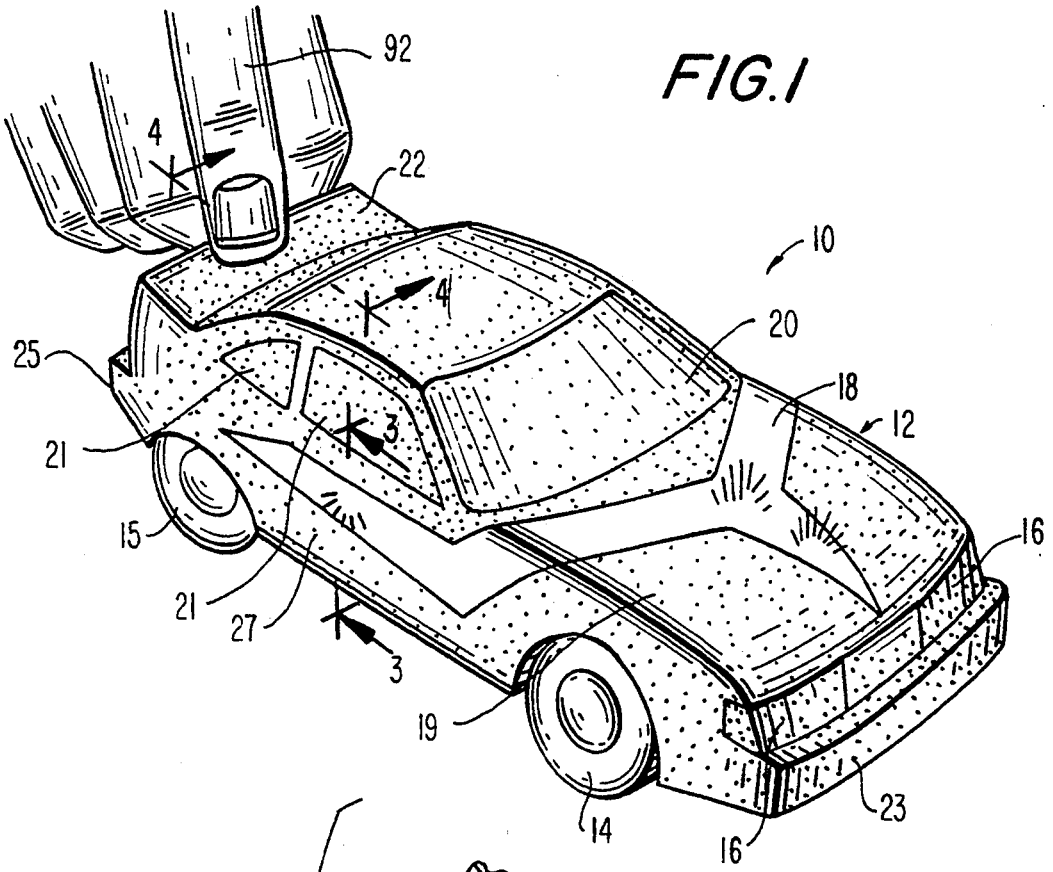
FIG. 1 is an elevated front perspective view of a toy vehicle constructed in accordance with the present invention.

Referring now to the drawings, FIG. 1 illustrates a toy vehicle, more particularly a toy automobile, identified by the general reference numeral 10 and constructed in accordance with the present invention. Although in the preferred embodiment the vehicle 10 is a toy automobile, it is contemplated that the toy could be in the form of any real or imaginary vehicle such as an automobile, aircraft, boat, spacecraft, or truck, or the like.

Figure 3:
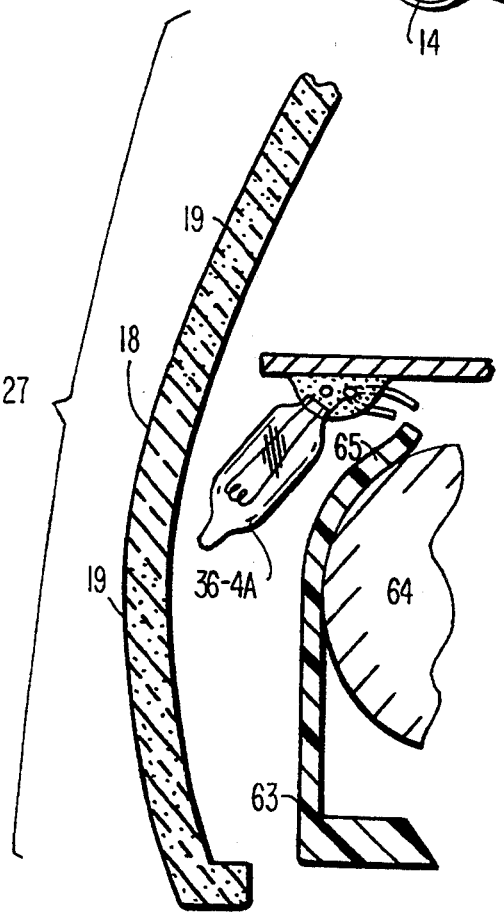
FIG. 3 is a cross-sectional view taken along the lines 3—3 of FIG. 1.
Figure 2:
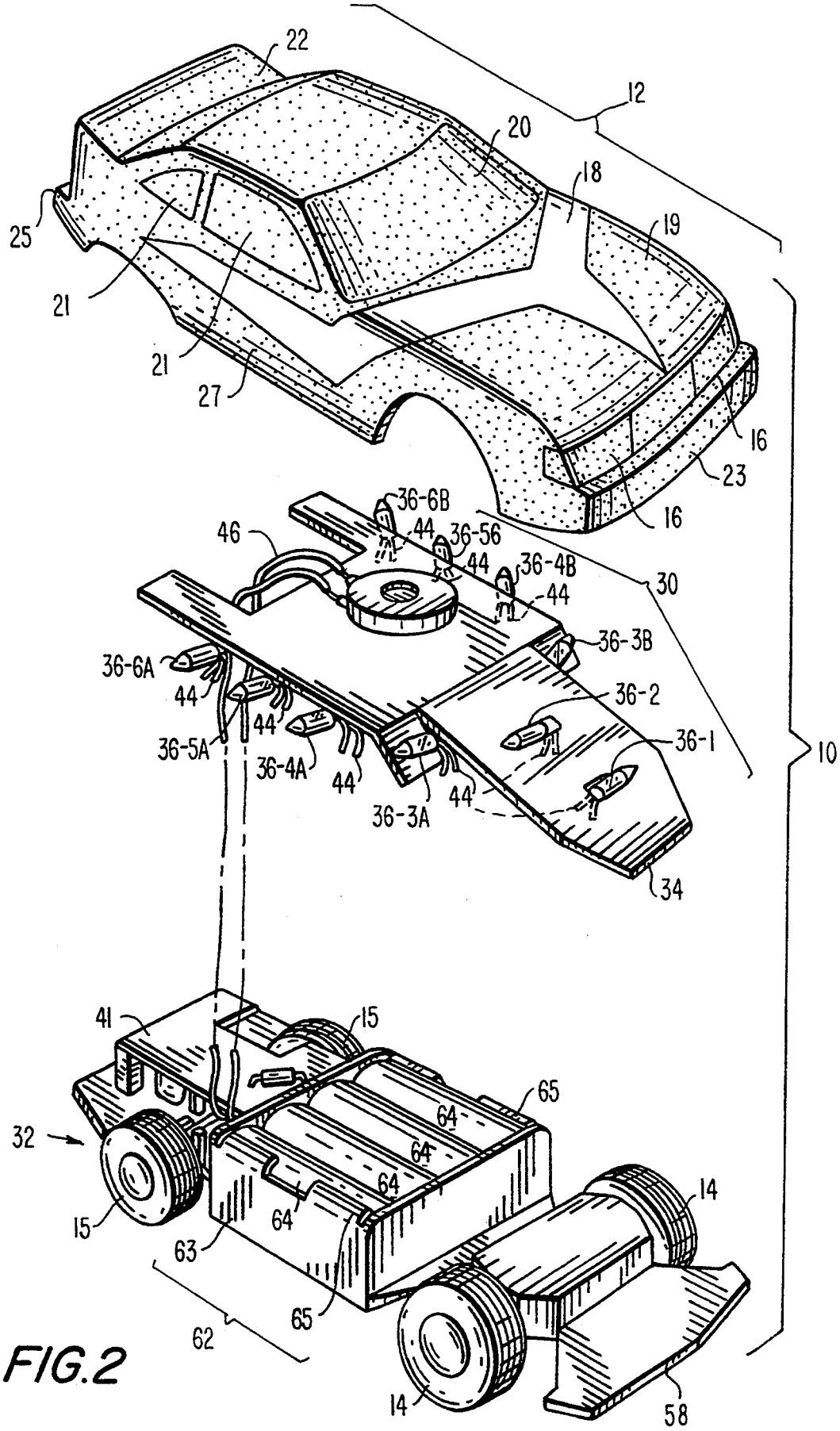
FIG. 2 is an exploded view of the vehicle of FIG. 1.

The toy automobile 10 comprises a body shell 12 formed of a hardened durable material, as by way of example molded plastic, a pair of axially aligned front wheels 14 and a pair of axially aligned rear wheels 15 (as best seen in FIG. 2), headlights 16, a substantially transparent portion 18, an opaque portion 19, windshield 20, side windows 21 and rear portion 22. As used herein, the term substantially transparent is intended to denote the ability of a material to pass light therethrough and should be understood including variously transparent and translucent surfaces and materials. On the other hand, the opaque portion 19 should be such as to not permit the substantial transmission of light therethrough. The body 12 also includes front fender 23 and rear fender 25. As perhaps best seen in FIG. 3, side portions 27 of the body 12 have a somewhat arcuately-shaped cross-section; this arrangement effectively simulates the typical appearance of an automobile. As explained in detail hereinbelow, the substantially transparent portion 18 permits the transmission therethrough of light from a plurality of illuminating devices disposed within the body shell 12, such for example as the illuminating device **36-4*a* disposed in proximity to the portion 18**.

Turning now to FIG. 2, within the body 12 the toy automobile 10 is provided with a light and sound assembly 30 and chassis 32. As constructed, the light and sound assembly 30 and chassis 32 are secured to the body portion 12 such, for example, as by frictional engagement.

The light and sound assembly 30 comprises a support member 34 that is shaped so as to be accommodated in body 12 and secured to the top of chassis 32 by conventional means, such as an adhesive. In the preferred embodiment, the support member 34 is also formed of a hardened plastic material. The light and sound assembly 30 further comprises a plurality of illuminating devices 36-1 to **36-6*b* which may be implemented as incandescent lights or light emitting diodes or the like, and sound output means 38 such, for example, as a conventional electromagnetic speaker or piezoelectric device or the like. While the preferred embodiment illustrates ten such illuminating devices, any appropriate number of illuminating devices may be utilized. The plurality of illuminating devices 36-1 to 36-6*b* and the sound output means 38 are conventionally secured to the support member 34 and are electrically connected to a control circuit 41 mounted on a circuit board 42 by pairs of wires 44 and 46, respectively. The plurality of illuminating devices 36-1 to 36-6*b* are furthermore disposed in suitable proximity to the substantially transparent portion 18 so that when each of the illuminating devices 36-1 to 36-6*b* is illuminated, the resulting light emission is transmitted through the substantially transparent portion 18 and not through the opaque portion 19. For example, and referring back to FIG. 3, one of the illuminating devices 36-4*a* is disposed in proximity to the substantially transparent portion 18 and when it is illuminated, the light thereby emitted is transmitted through the substantially transparent portion 18 and is viewable from an exterior side of body 12 and not through opaque portion 19**.

In the preferred embodiment, the substantially transparent portion is arranged as a substantially Y-shaped pattern. As such, the illuminating devices 36-1 to **36-6*b* are arranged in proximity along the Y-shaped pattern, with the point of the Y-shaped pattern being positioned in the front center hood of the body 12 and the "tails" of the pattern extending along the respective, oppositely-disposed sides 27 of the automobile 10. The illuminating devices 36-1 to 36-6*b* are connected to and under the operative control of a control circuit 41** which repeatedly and sequentially energizes and deenergizes the illuminating devices from the front of the Y-shaped pattern to the tails thereof.

In the preferred embodiment, the chassis 32 is formed of a hardened plastic material. The chassis 32 includes the pair of front wheels 14 and the pair of rear wheels 15, each of the opposed front and rear wheels being connected to the other by a front axle (not shown) and a rear axle 52 (FIG. 5), respectively. Front (not shown) and rear channels 39 (FIG. 5) are provided in chassis 32 for receiving the front axle and rear axle 52, respectively. The rear channel 39 is defined by the chassis 32 and an upwardly-extending member 45 projecting perpendicularly from the top face of the chassis 32. The front axle may be secured to the chassis 32 in any suitable manner, as by a spring (not shown), and the rear axle 52 is secured to the chassis 32 by a spring 40. As explained below, the spring 40 permits displacement of the body 12 and chassis 32 of the toy automobile in the downward direction relative to the rear axle 52, when the toy body 12 is pressed downwardly at the portion 22 as, for example, by a user's finger 92.

Furthermore, the chassis 32 includes a front piece or extension 58 for providing additional mechanical support and strength to the body 12. An energy or power source, such as the battery holder 62 having walls 63 with substantially curved portions 65, is also provided. The battery holder 62 is adapted to receive, for frictional engagement therewithin, a plurality of standard batteries 64. The batteries 64 supply an appropriate amount of electrical energy for operating the control circuit 41. As should be appreciated, it is presently contemplated that other sources of electrical energy may alternatively be substituted for the batteries 64, such as photovoltaic cells or the like.

Referring now to FIGS. 4 and 4A, the control circuit 41 is shown to include or be associated with a mechanical switch means 72 operable for energizing and deenergizing the control circuit 41. In the preferred embodiment, the switch means 72 is formed in part by the spring 40 fixedly secured to the chassis 32 of the body 12 as, for example, by screw 76. Spring 40 is constructed of an electrically conductive material such as copper and is electrically connected to the batteries 64 by wire 78. Wire 78 is electrically and mechanically attached to spring 40 by, for example, a solder joint 80. As will be apparent to those of ordinary skill in the art, other means may alternatively be employed to electrically connect the wire 78 to the spring 40 or, indeed, to electrically connect the batteries 64 and spring 40. The switch means 72 is further formed by another contact 82 fixedly secured to the chassis 32 by, for example, a screw 84 and wire 86 electrically connects contact 82 to the control circuit 41. Wire 86 is also electrically and mechanically attached to contact 82 by, for example, a solder joint 88. As explained below, in the relaxed or nondisplaced state, the contacts 74 and 82 are separated by a gap 96. The gap 96 breaks the electrical connection to control circuit 41, thus deenergizing that circuit. When the rear portion 22 of body 12 is downwardly displaced or depressed as for example, by a user's finger 92, the rear portion 22 of the vehicle body is displaced in the direction as shown by the arrow, and the spring 40 is brought into electrical connection with the contact 82 (as seen in FIG. 4A) thereby energizing the control circuit 41. Of course, as should be apparent other types of switch means, such as a capacitive-touch switch, or pressure switch or the like, may alternatively be employed in lieu of the illustrated switch means 72.

FIG. 5 is a cross-sectional view taken along the lines 5—5 of FIG. 4. That Figure illustrates in solid lines the rear portion 22 of the body 12 in its relaxed or undepressed state. The dotted lines in FIG. 5 illustrate the position of the rear portion 22 of body 12 when the rear portion 22 is depressed and thereby displaced toward the supporting ground surface. As shown in FIGS. 4, 4A and 5, as the rear portion 22 is depressed downward, that rear portion of the toy vehicle is displaced in the downward direction. The axle 52 exerts an upward force on the spring 40, and spring 40 deflects in the upward direction until it touches or abuts the contact 82. When spring 40 touches contact 82, the electrical current is completed and operating power is applied to the control circuit 41. Put another way, the control circuit 41 is thereby electrically connected to the batteries 64, energizing the control circuit. When the rear portion 22 is thereafter released, the spring 40 exerts a downward force on the axle 52, thus displacing the body of the toy vehicle 10 in the upward direction, and reinstating the gap 96 between the spring 40 and contact 82 to open the circuit and deenergize the control circuit 41.

Figure 6:
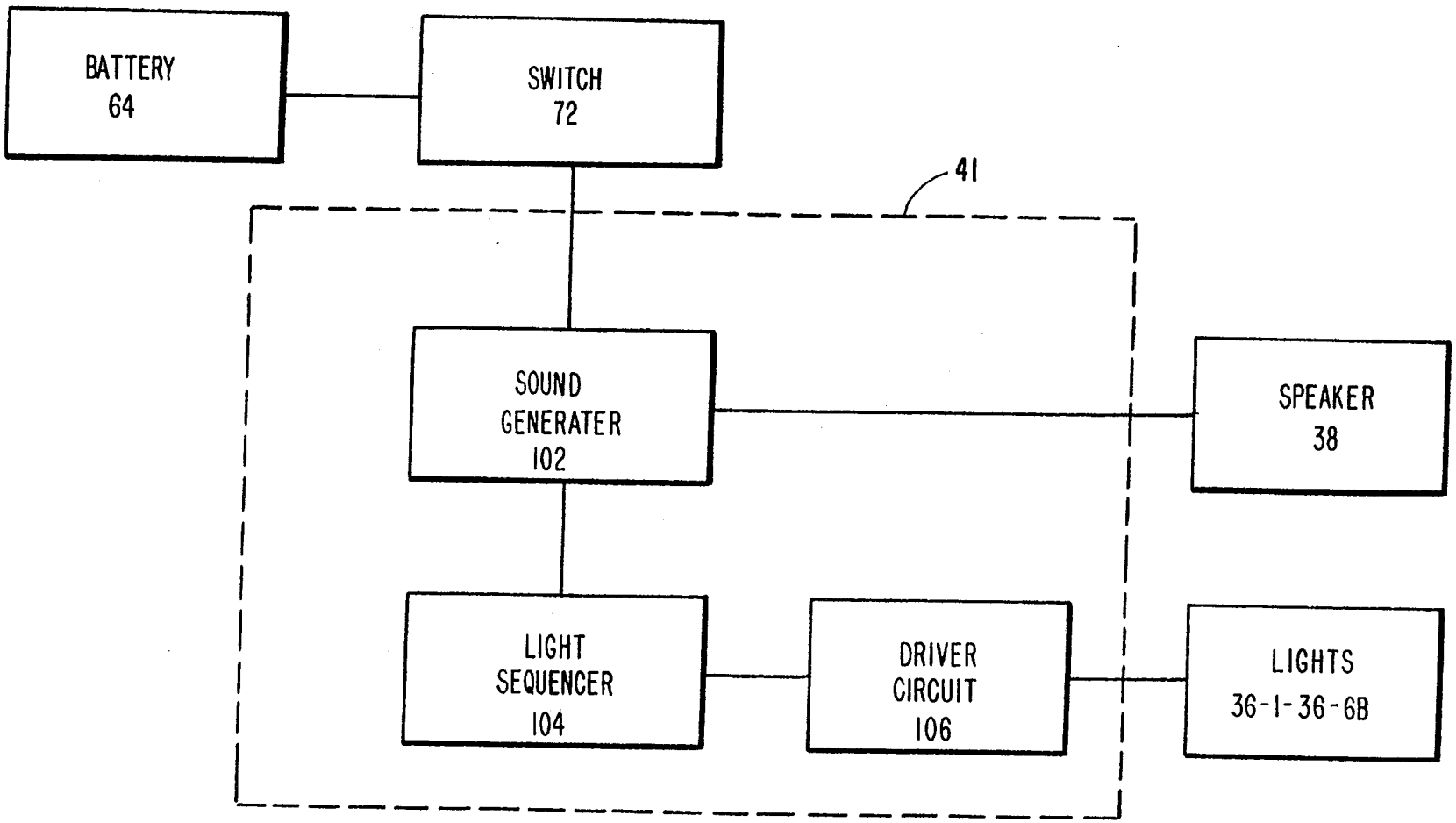
FIG. 6 is a block diagram of the control circuit of the vehicle of FIG. 1.

FIG. 6 is a block diagram of the control circuit 41 and its peripheral components. As shown in that Figure, the control circuit 41 is supplied with electrical energy from batteries 64 through switch means 72. When switch means 72 is closed by depressing the rear body portion 22, as discussed above, the control circuit 41 is energized. Control circuit 41 includes a sound generator 102 electrically connected to the sound output means 38 by wires 46 and operatively supplies an appropriate electrical signal for generating sounds. Such sounds preferably simulate the toy vehicle in motion, as for example, through engine sounds or "VROOOM" sounds or the like. Control circuit 41 also includes a light sequencer circuit 104 for providing signals to energize and deenergize the individual illuminating devices 36-1 to **36-6*b* by way of driver circuit 106. In the preferred embodiment the illuminating devices 36-1 to 36-6*b* are rapidly and repeatedly energized and deenergized by the sequencer circuit 104 in the manner shown Table 1, commencing with the front-most illuminating device 36-1**.

TABLE 1

| Sequence | Light(s) |
|---|---|
| 1 | 36-1 |
| 2 | 36-2 |
| 3 | 36-3a and 36-3b |
| 4 | 36-4a and 36-4b |
| 5 | 36-5a and 36-5b |
| 6 | 36-6a and 36-6b |

The driver circuit 106 provides signals of the appropriate voltage and current to the illuminating devices in accordance with the initiating signals received from the light sequencer circuit 104. As the plural illuminating devices 36-1 to **36-6*b* are serially and sequentially energized and deenergized by the sequencer 104 and sounds are concurrently generated by the sound generator 102**, the toy automobile given an appearance and impression and effect of rapid motion even though, in fact, the toy does not actually move unless manually displaced along the underlying support surface by the user.

METHOD OF MANUFACTURE OF THE BODY

The chassis 32 and support member 34 may be formed of a hardened plastic material and may be manufactured by any suitable conventional techniques, such as injection molding. In accordance with the invention, the body shell 12 is also formed of a substantially transparent plastic material, in the shape of an automobile body by way of example, using a conventional injection molding process or the like. The entire body shell 12 is preferably of unitary construction. In the generally contemplated injection molding process a liquified, substantially transparent plastic material is injected under pressure into a mold. After hardening the body 12, which is substantially transparent, is removed from the mold. Of course, other techniques may alternatively be utilized in forming the body 12 so long as the same is initially formed as a single, unitary shell that is substantially transparent throughout its entire extent.

The intended substantially transparent portions of the completed toy 10, such as the portion 18 and, if desired, windshield 20 and windows 21, are then defined. The opaque portion is also defined to include the entire body 12 except for the predefined substantially transparent portions. This may be accomplished by positioning the body 12 in a jig so that a mask is placed over the predefined substantially transparent portions, such as the portion 18, windshield 20 and windows 21. A coating material is then applied to the body 12 so that the coating material blocks transmission of light through the opaque portion 19 from an internal portion of the body to an external portion thereof. As used herein, the term coating material is intended to denote a material which can cover and adhere to the body 12 in the opaque portion 19 and should be understood to include various materials such as paint or an opaque web material. The web material may include, by way of example, a decal. For example, the masked body 12 may be sprayed with paint to form the opaque portion 19 in areas not covered by the mask. Additional details of and designs on the automobile body may also be painted on the opaque portions, and/or on the substantially transparent portions, at this time. After the opaque portions of the body have been painted, the mask is removed. Then, after the paint has dried, the body 12 is assembled to the support member 34 and chassis 32. In particular, the illuminating devices 36-1 to **36-6*b* are mounted on the support member 34 within the body 12 in proximity to the substantially transparent portion 18 so that when the illuminating devices are illuminated, the emitted light is visible through the proximate transparent portion(s) from an exterior side of the body 12**.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A method for manufacturing a toy vehicle, comprising the steps of:

forming a substantially transparent vehicle body having a front, a back, an interior side and an exterior side;

defining at least one substantially transparent portion of said body having a substantially Y-shaped pattern, wherein said Y-shaped pattern extends longitudinally and continuously along said vehicle body from a front hood of the body to and along opposite sides panels of said vehicle body, said Y-shaped pattern comprising a first portion extending on and longitudinally along at least a portion of said front hood substantially centrally between said side panels, and a pair of leg portions extending rearwardly from said first portion, each said leg portion extending rearwardly on and along said front hood and then continuously from said front hood rearwardly on and along a respective one of said side panels;

defining an opaque portion of said body, said opaque portion comprising all of said body except for said at least one substantially transparent portion;

arranging a mask on said vehicle body such that said mask is disposed protectively over said at least one substantially transparent portion;

applying a coating material to said vehicle body such that the coating material is applied to said vehicle body only at said opaque portion, wherein said applied coating material is effective to substantially block transmission of light from said interior side to said exterior side of said body at said opaque portion;

mounting a plurality of individually energizable illuminating devices within said body and proximate said at least one substantially transparent portion such that when each of said plural illuminating devices emits light, the emitted light is transmitted through said at least one substantially transparent portion for viewing from said exterior side of said body; and providing within said body a controller operable for repeatedly and individually sequentially energizing and deenergizing said plural illuminating devices for illumination of said devices sequentially and serially along said substantially Y-shaped pattern from the front to the rear of said body to thereby simulate rapid forward motion of the vehicle body.

2. A method according to claim 1, further comprising the step of providing in said body a sound generator operable to generating a sound simulating motion of the toy vehicle.

3. A method according to claim 1, wherein said forming step comprises the step of unitarily constructing said vehicle body of a plastic material.

4. A method according to claim 1, wherein said coating material comprises an opaque web material.

5. A method according to claim 4, wherein said opaque material comprises a least one decal.

6. A toy vehicle comprising:

a unitarily constructed vehicle body having a front, a back, an interior side and an exterior side and comprising at least one substantially transparent portion and an opaque portion, said at least one substantially transparent portion having a substantially stripe-shaped pattern extending longitudinally and continuously along said vehicle body from a front hood of the body to and along opposite side panels of said vehicle body, said opaque portion comprising all of said body except for said at least one substantially transparent portion, said stripe-shaped pattern comprising a first portion extending on and longitudinally along at least a portion of said front hood substantially centrally between said side panels, and a pair of leg portions extending rearwardly from said first portion, each said leg portion extending rearwardly on and along said front hood and then continuously from said front hood rearwardly on and along a respective one of said side panels so that said stripe-shaped pattern substantially defines a Y-shaped pattern on said vehicle body;

a plurality of independently operable illuminating devices disposed within the interior side of said body and proximate said stripe-shaped pattern such that when each of said plurality illuminating devices is operated to emit light, the emitted light is transmitted through said stripe-shaped pattern for viewing from said exterior side of said body; and a controller operable for repeatedly and individually sequentially energizing and deenergizing said plurality of illuminating devices for illumination of said devices sequentially and serially along said substantially stripe-shaped pattern from the front to the rear of said body to thereby simulate rapid forward motion of the vehicle body.

7. A toy vehicle according to claim 6, further comprising a sound generator operable for generating a sound simulating motion of said toy vehicle.

8. A toy vehicle comprising:

a vehicle body having a front, a back, an interior side and an exterior side and comprising at least one substantially transparent portion and an opaque portion, said opaque portion comprising all of said body except for said at least one substantially transparent portion;

a plurality of operable illuminating devices disposed within said body and proximate said at least one substantially transparent portion such that when each of said plural illuminating devices is operated to emit light, the emitted light is transmitted through said at least one substantially transparent portion for viewing from said exterior side of said body; and a controller operable for repeatedly and sequentially energizing and deenergizing said plurality of illuminating devices for illumination of said devices in a sequential and serial manner to simulate motion of said toy vehicle;

said at least one substantially transparent portion comprising a substantially stripe-shaped pattern extending longitudinally and continuously along said vehicle body from a front hood of the body to and along opposite side panels of said vehicle body, said stripe-shaped pattern comprising a first portion extending on and longitudinally along at least a portion of said front hood substantially centrally between said side panels, and a pair of leg portions extending rearwardly from said first portion, each said leg portion extending rearwardly on and along said front hood and then continuously from said front hood rearwardly on and along a respective one of said side panels so that said stripe-shaped pattern substantially defines a Y-shaped pattern on said vehicle body, and wherein said controller is operable for repeatedly and sequentially energizing and deenergizing said plurality of illuminating devices for illumination of said devices sequentially and serially along said substantially stripe-shaped pattern from the front to the rear of said body to thereby simulate rapid forward motion of the vehicle body.

9. An apparatus according to claim 8, further comprising:

at least a pair of wheels operatively connected to and relatively moveable with respect to said vehicle body; and switch means operatively connected to said pair of wheels and electrically connected to an energy source and to said controller, wherein when said pair of wheels is moved relative to said vehicle body, said switch means closes to thereby energize said controller.

10. An apparatus according to claim 9, wherein said switch means comprises a first connection member operatively connected to said pair of wheels and electrically connected to an energy source and a second connection member operatively connected to said vehicle body and electrically connected to said controller, and wherein when said pair of wheels is moved relative to said vehicle body, said first connection member comes into electrical contact with said second connection member to thereby energize said controller.

* * * * *